US008574471B2

(12) United States Patent
Prater

(10) Patent No.: US 8,574,471 B2
(45) Date of Patent: Nov. 5, 2013

(54) SYSTEM AND METHOD FOR FORMING CONCRETE STRUCTURES

(76) Inventor: Lawrence M. Prater, Reno, NV (US)

( * ) Notice: Subject to any disclaimer, the term of this patent is extended or adjusted under 35 U.S.C. 154(b) by 383 days.

(21) Appl. No.: 13/070,438

(22) Filed: Mar. 23, 2011

(65) Prior Publication Data

US 2011/0233801 A1 Sep. 29, 2011

Related U.S. Application Data

(60) Provisional application No. 61/316,681, filed on Mar. 23, 2010.

(51) Int. Cl.
*E04B 1/16* (2006.01)

(52) U.S. Cl.
USPC ..... 264/34; 264/219; 249/34; 249/40; 249/45; 249/46; 249/155; 249/156; 249/160; 249/163; 249/168; 249/189; 249/190; 249/191; 52/741.15; 52/741.13

(58) Field of Classification Search
USPC ..... 264/34, 219; 249/34, 40, 45, 46, 163, 249/168, 191; 52/741.15, 741.13
See application file for complete search history.

(56) References Cited

U.S. PATENT DOCUMENTS

| | | | | |
|---|---|---|---|---|
| 1,784,329 | A * | 12/1930 | Bierhaalder | 249/45 |
| 2,273,699 | A * | 2/1942 | Fenton | 264/34 |
| 2006/0180732 | A1 * | 8/2006 | Lawrence | 249/34 |

* cited by examiner

*Primary Examiner* — Joseph S Del Sole
*Assistant Examiner* — David N Brown, II
(74) *Attorney, Agent, or Firm* — Long & Chybik; John D. Long, Esq

(57) ABSTRACT

One possible embodiment of the invention could be a system for creating forms used to make concrete structures comprising of plurality of panels, each panel having two or more sets of spaced-apart tie apertures; a plurality of ties, each tie forming a body between two ends, each end having a locking aperture, a plurality of L-shaped brackets with two flanges having a respective set of spaced-apart perforations; a plurality of locking mechanisms that attach to ties and connect L-shaped brackets together; wherein two or more ties are located between a pair of parallel and opposing panels, the ends of the ties protruding through respective tie apertures and perforations of L-shaped brackets located on the outside of the panels, the locking mechanisms engaging respective locking apertures to form an assembled pair of panels, the assembled pairs being connected together to create a form with a continuous cavity to receive plastic concrete.

20 Claims, 11 Drawing Sheets

SYSTEM AND METHOD FOR FORMING CONCRETE STRUCTURES

CROSS-REFERENCES TO RELATED APPLICATIONS

This application claims the benefit under 35 U.S.C. §119 (e) of U.S. Provisional Patent Application No. 61/316,681, filed on Mar. 23, 2010, the contents of which are relied upon and incorporated by reference.

STATEMENT REGARDING FEDERALLY SPONSORED RESEARCH OR DEVELOPMENT

Not Applicable.

REFERENCE TO A "MICROFICHE APPENDIX"

Not Applicable.

FIELD OF THE INVENTION

The present invention may relate to systems and methodologies for forming concrete structures. More specifically, the present invention may related to those such systems and methodologies utilizing forms generally comprising of thin, lightweight panels of low strength materials that are spaced apart in opposing and parallel orientation to one another by ties generally located between such panels.

BACKGROUND

Current methodologies for forming structures made from concrete (generally a cement aggregate, substantially made from ingredients such as Portland cement, sand, gravel, and water; in its semi-liquid state it is substantially known as plastic concrete and once set, it is generally known as concrete) re-enforced and otherwise, may be considered to be expensive and/or labor-intensive in that such methodologies generally require the use of relatively heavy, thick, and bulky forms that substantially require assembly by crews having specialized knowledge and training. Using such construction systems and associated methodologies, concrete footing (e.g., foundation) and corresponding concrete wall structures may be created by pouring plastic concrete into cavity denoted by form that is made from connected panels held in place by framing and stakes. Once the pour is completed and sufficiently set, the forms (framing, stakes, panels, and alike) may be disassembled and removed to be later reused to create another form for another concrete structure. These forming systems and methodologies may be utilized to build various commercial structures such as office buildings, commercial retail structures, heavy industrial structures, multiple family residential structures and the like wherein a sizable amount of concrete needs to be poured to create the footings and subsequent walls for such structures.

The amount of plastic concrete needed to create concrete structures for such heavy construction may require the panels of corresponding concrete forms to be made from relatively resilient material (e.g., plywood or a metal, like steel) with sufficient thickness. The panels may need to be strong enough to withstand the pressure that the poured plastic concrete may exert against them until the concrete sets. By analogy, such exerted pressure is much like that pressure that retained water presents against a dam wall. However, once the plastic concrete in the form has set into concrete, the pressure it previously exerted as plastic concrete as applied to panels of the form is generally abated.

These heavy-duty concrete form systems may also be employed for other building structures having building and construction needs requiring significantly less concrete than heavy construction projects of a commercial nature. These other structures may include light commercial structures and single family residential homes. The heavy-duty concrete form systems could be seen as being more robust than is needed for handling the much reduced plastic concrete requirements (and respective exerted panel pressures) as found in those light construction projects. As a result, the heavy duty concrete form systems may add significantly to the construction costs of such light construction projects without providing a corresponding benefit. The needs of light construction could be met instead by a light duty, concrete form system and method using comparatively thin and lightweight panels to generally handle smaller concrete forming needs at reduced costs.

Additionally, in developing nations subjected to natural disasters such as hurricanes, typhoons, or earthquakes, reconstruction of inexpensive concrete structures resistant to wind and seismic forces is hampered by the attributes of the current forming methods. The bulk and weight (and hence costs) of transporting heavy duty concrete forming systems to such areas along crews of specially trained personnel to erect the forms, may inhibit or otherwise delay either the initial construction or reconstruction of concrete structures to such areas that may have suffered natural disaster or the like.

What is needed therefore is a lightweight hulk, easily transported, and easily assembled concrete form system with an accompanying method that can be easily utilized by unskilled labor for light duty construction. Such a system could utilize a unitary, lightweight panels spaced apart in opposing and parallel configuration by ties to generally create a form that substantially denotes a cavity into which the plastic concrete may be poured to form the desired concrete structure. The method for this system could control the rate/amount of the plastic concrete is poured into cavity of the form so that the placement of plastic concrete into the cavity does not overload the form's holding capacity (e.g. rupture one or more lightweight, lower strength panels or the assembly of such panels.) The method could accomplish this control through delayed timing or otherwise staggering the introduction or pour of the plastic concrete into the form to substantially allow a previously introduced plastic concrete to set (becoming concrete and reducing the accompanying pressures upon the lightweight panels) before introducing a subsequent plastic concrete into the assembled form. This action could reduce the operating amount of pressure exerted by plastic concrete on the form at any one time to substantially allow the form panels to be made from less resilient (and generally lighter) materials such as sheet metal and corrugated cardboard components (or possibly use thinner/less amounts of materials currently used in concrete forms thus resulting in lighter or lightweight panels of such materials.) The use of such lighter materials or reduction (e.g., thinner panels) of heavier materials in the making of form panels could make the system more lightweight, more compact (prior to assembly), less costly, and easier to transport. The invention's components may further be easily palletized and bundled, allowing sets of said components for forming numerous structures can be shipped in one standard shipping container.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to form concrete structures utilizing thin panels of comparative lightweight, low resilience, low strength material;

provide a concrete form made from corrugated cardboard panels;

the ability to time the pour of plastic concrete into a form assembled from a light weight panels so as not to rupture panels individually or their overall assembly;

provide a concrete form system whose parts that are lightweight, inexpensive, and easy to assemble with unskilled labor;

provide a concrete form made from panels held in spaced-apart parallel orientation by ties, the ties having ends that are broken off at the formed concrete structure when the panels of the form are removed from the formed concrete structure;

provide a concrete form system with panels having perforated protruding flanges to allow easy securing of stacked assembled pairs of panels to adjust the height of the concrete form;

provide a concrete form system with panels whose perforated protruding flanges to allow easy tandem connection of assembled sections of panels to adjust the length of the form;

the ability to form concrete structures utilizing ties to holding a pair of panels in spaced apart and opposing orientation;

provide a concrete form system whose elements are compact, easy-to-assemble/disassemble, and inexpensive to transport;

the ability to orient a top tier of ties holding pairs of panel in an assembled a concrete form in a manner that allows a top layer of plastic concrete that is level with the top edge of the form to be screed flat;

provide concrete form system whose ties holding pairs of panels in parallel and spaced apart orientation can engage perforated flanges of other pairs of panels to allow a concrete foundation to engage and hold an assembled wall form in place on top of the foundation;

the ability to be construct a concrete form from connected pairs of spaced apart, parallel panels using connecting L-shaped brackets secured to the outer sides of the panels by locking mechanisms; and provide a concrete form system using reversible locking mechanisms that allows the reuse of panels and other parts of the system for subsequent creation of concrete forms.

These and other advantages may be realized by reference to the remaining portions of the specification, claims, and abstract.

Brief Description of One Embodiment of the Present Invention

One possible embodiment of the invention could be a system for creating a form used to make concrete structures comprising of panels, each panel having multiple sets of spaced-apart tie apertures set in a longitudinal orientation upon the panel, each set spaced apart from the another in a parallel configuration; ties, each tie comprising of a body, ends, stop tabs, the body being located between two ends with each end having a locking aperture, the stop tabs located between a respective end and the body; L-shaped brackets having top and bottom flanges connected along a common edge in perpendicular orientation to one another, each flange further having a respective set of spaced-apart perforations located along the center length of the flange; locking mechanisms that attach to ties as well as connect L-shaped brackets to one another; wherein two or more ties are located between and perpendicular to at least a pair of panels to hold the panels in spaced-apart, parallel and opposing orientation, the ends of the ties protruding through respective tie apertures and corresponding perforations of plurality of panel L-shaped brackets longitudinally located on the outside of the panels along a respective set of tie apertures, said panels and L-shaped brackets being held in place on the ends by locking mechanisms respectively engaging locking apertures to form an assembled pair of panels to create a cavity into which plastic concrete maybe poured to make a concrete structure.

Another possible embodiment of the invention could be a method of using forms for creating concrete structures comprising of the following steps: providing panels, ties, perforated L-shaped brackets, and locking mechanisms, the ties holding pairs of panels in spaced-apart parallel orientation with ends of the ties penetrating through the panels and perforations of the L-shaped brackets located on the outside of the panels, the locking mechanism holding L-shaped bracket and panel in place on the end of the tie to form an assembled pair of panels well as further connecting assembled pairs of panels into a form for creating a concrete structure; assembling a form to create a concrete footing using panels, ties, L-shaped brackets and locking mechanisms; making a concrete footing using the form to create a concrete footing and incorporating the ties of the form into the concrete footing; removing locking mechanisms, L-shaped brackets, and panels from the concrete footing; assembling a form to make a concrete wall using panels, ties, L-shaped brackets, and locking mechanisms; attaching the form to make a concrete wall to ties incorporated in the footing; and making a concrete wall upon the concrete footing using the form to make a concrete wall.

Yet another possible embodiment of the invention could be a method of assembling a form for creating a concrete structure comprising of the following steps, but not necessarily in the order shown, providing a plurality of panels, each panel having two or more sets of spaced-apart tie apertures, each set of tie apertures being set in a longitudinal orientation upon the panel, each set of tie apertures being spaced apart from one another in a parallel configuration upon the panel: providing a plurality of ties, each tie having a rectangular body located between two ends, each end having a locking aperture to receive a locking mechanism, and one or more stop tabs located between a respective end and the body, the stop tab projecting outward from the tie; providing a plurality of panel L-shaped brackets having top and bottom flanges connected along a common edge in perpendicular orientation to one another, each flange further having a respective set of spaced-apart perforations located along the center length of the flange; providing a plurality of locking mechanisms that attach to ties as well as connect L-shaped brackets to one another; locating two or more ties between and perpendicular to at least a pair of opposing panels to hold the panels in spaced-apart, parallel orientation; longitudinally locating the panel L-shaped bracket on the outside of the panel to aligning the perforations of one flange of the bracket with the set of tie apertures; inserting the end of the tie through a respective tie aperture and corresponding perforation of panel L-shaped bracket; and engaging locking mechanism with respective locking aperture of the end of the tie to complete an assembled pair of panels.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
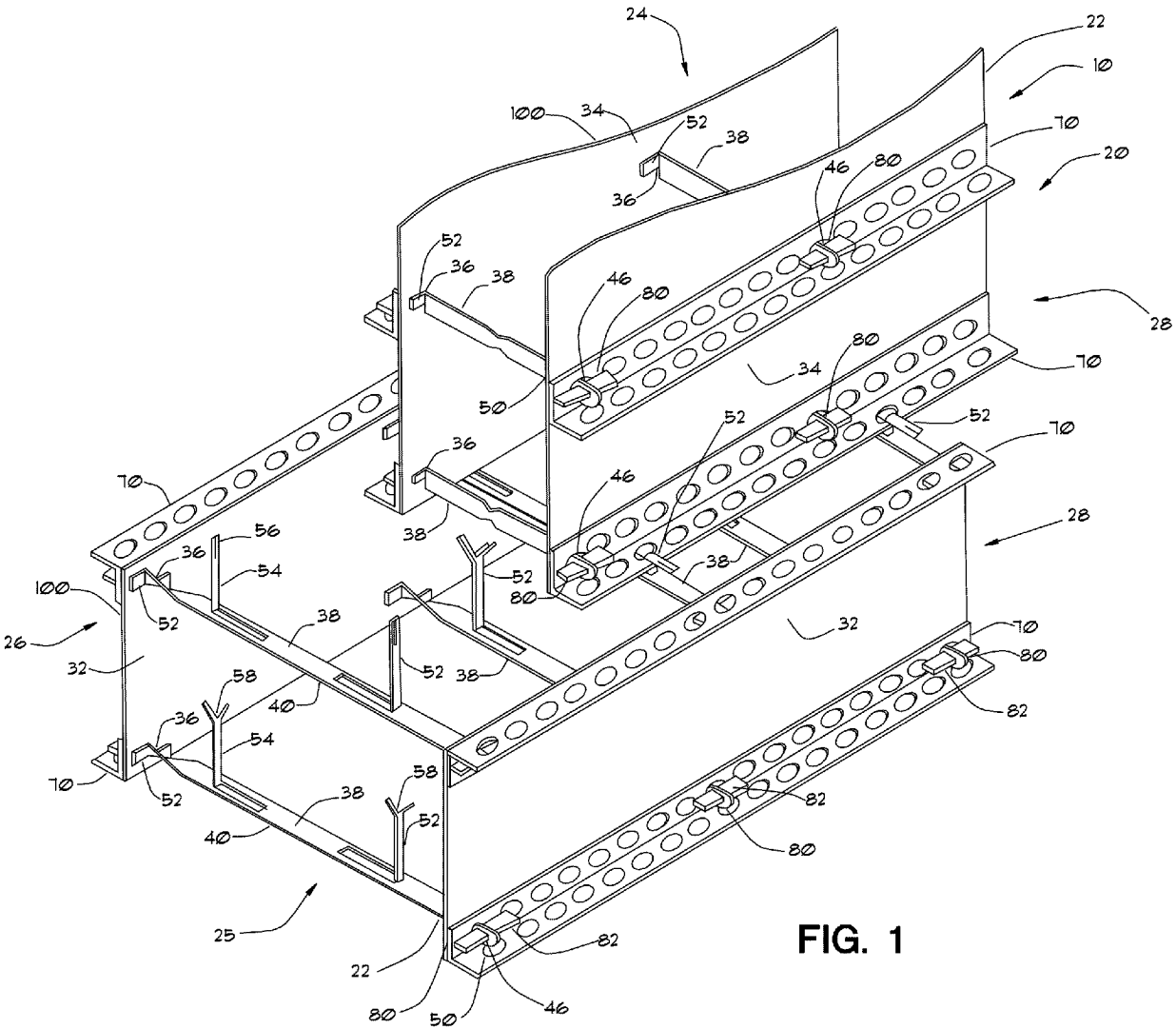
FIG. 1 is substantially a perspective cutaway view of one embodiment of assembled footing and wall forms of the present invention.
Figure 2:
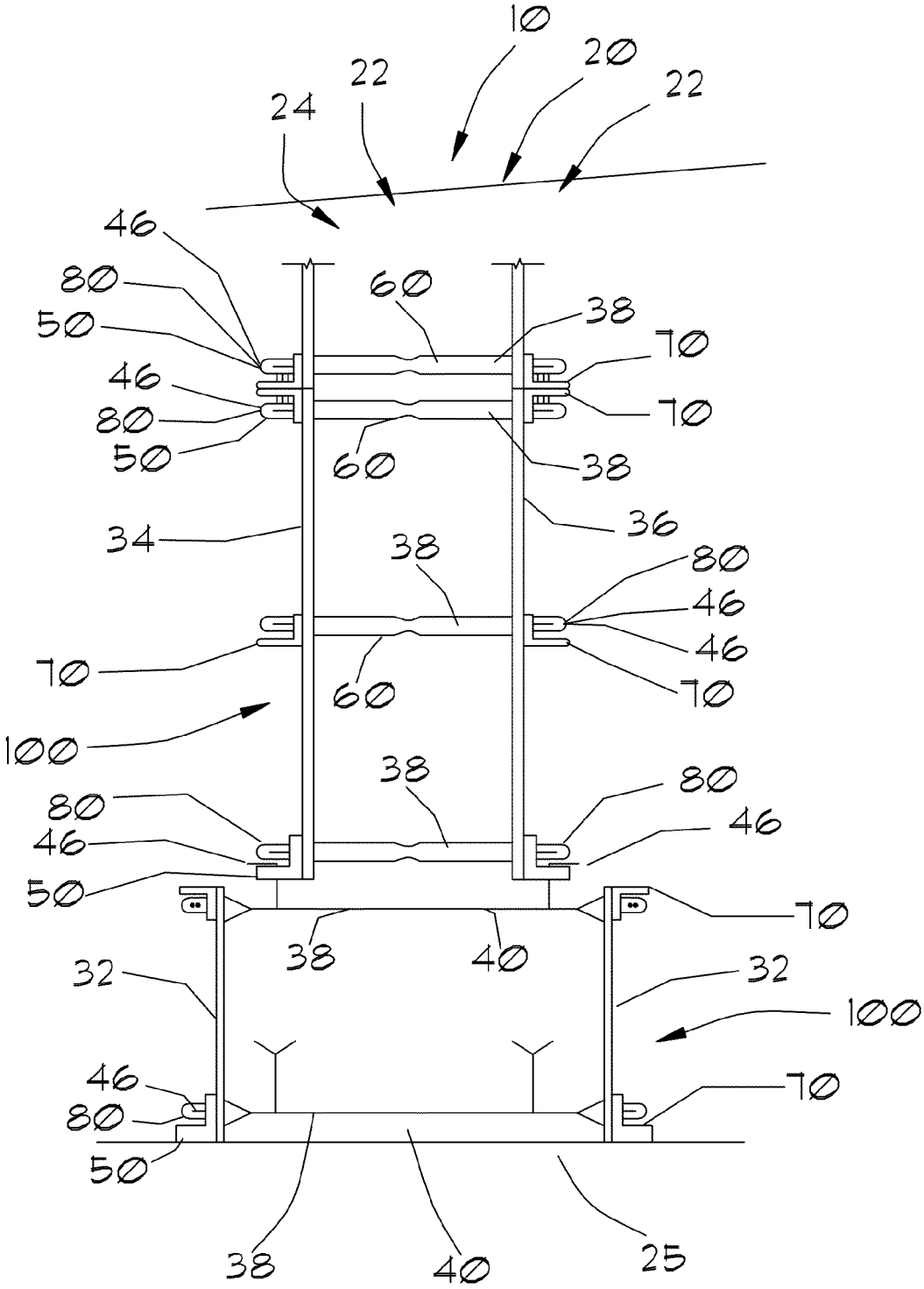
FIG. 2 is substantially an end view of one embodiment of assembled footing and wall forms of the present invention.
Figure 3:
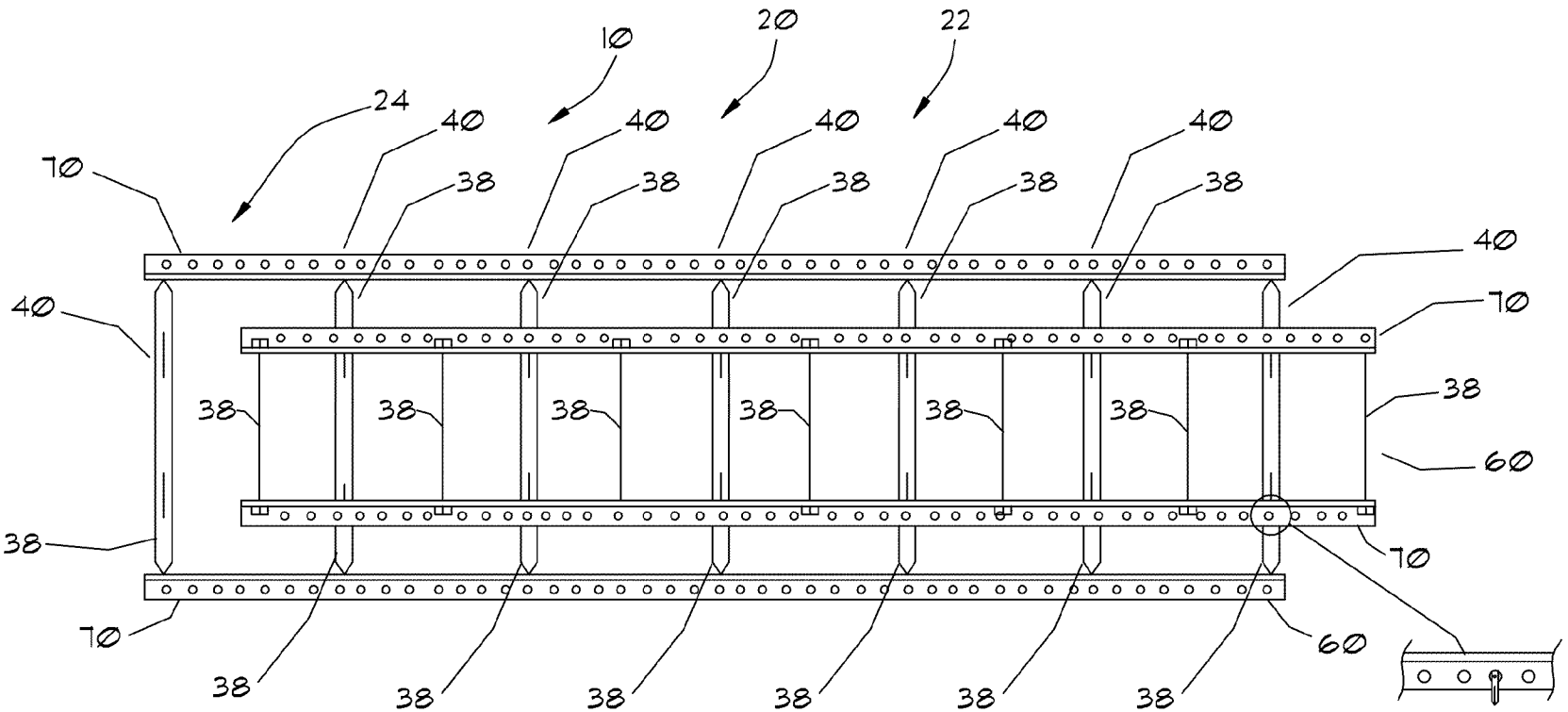
FIG. 3 is substantially a top view of one embodiment of assembled footing and wall forms of the present invention.
Figure 4:
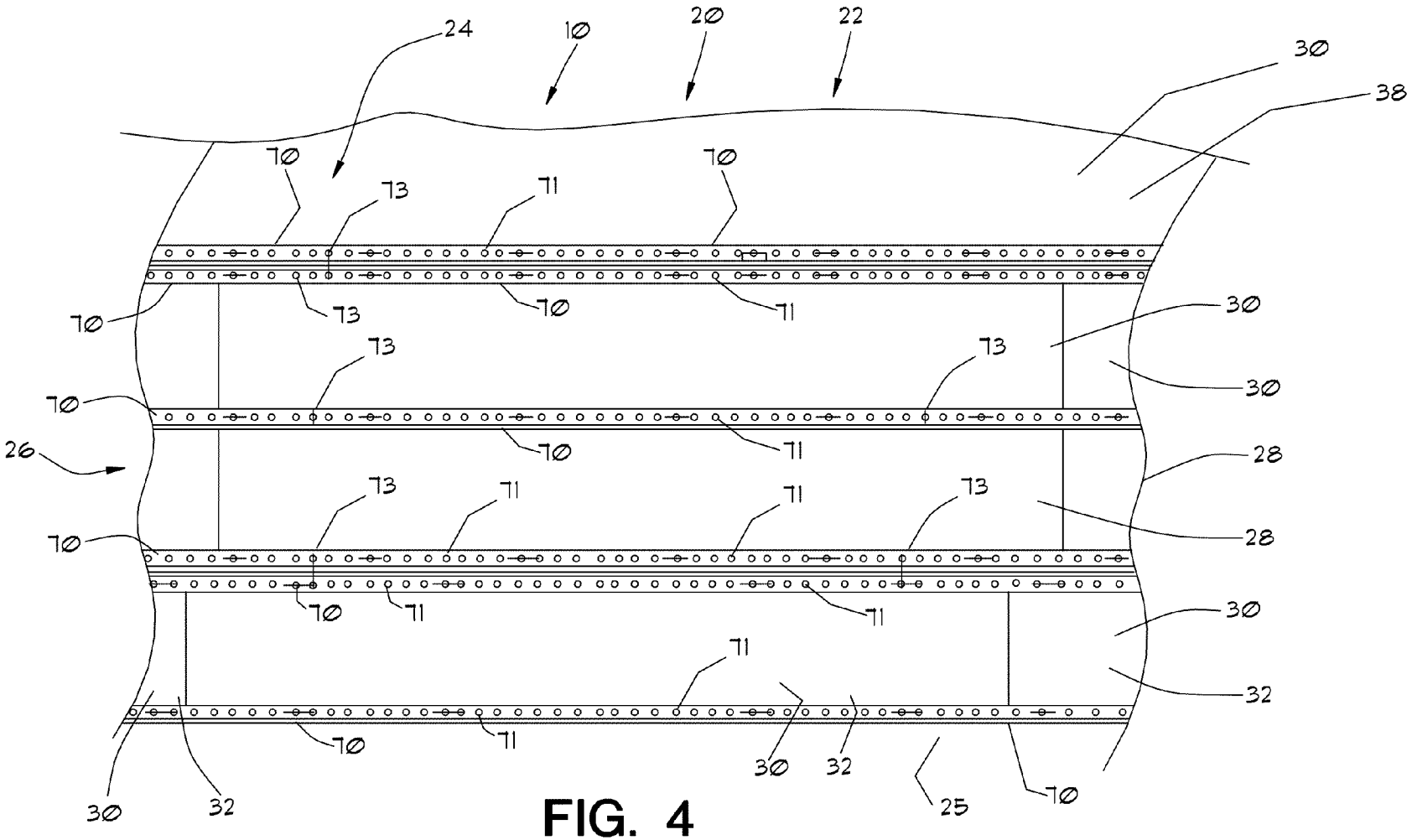
FIG. 4 is substantially a side view of one embodiment of assembled footing and wall forms of the present invention.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The present invention 10 could comprise of a system 20 and a method 200 for forming concrete structures (not shown) as used in light construction. As substantially shown in FIGS. 1, 2, 3, and 4, the system 20 could comprise of panels 30, ties 38, L-shaped brackets 60, and locking mechanisms 80 that are assembled into a form 22 used to create concrete structures (not shown.) The panels 30, in at least one embodiment, could be made from corrugated cardboard with scaled edges further having a water-proofing sealant (e.g. paraffin) applied to the entire panel 30. A releasing agent could be also be incorporated into the sealant or applied to the panel 30 after the application of the sealant.

Other embodiments could have the panels 30 made from other suitable substitute materials such as fiberboard or other similar wood products, but they would be thicker, heavier, and more difficult to cut than corrugated cardboard panels. Yet other embodiments of the invention 10 could use thinner and lighter panels 30 of plywood (as compared to those panels as used in heavy duty concrete forms technology.)

The inventor notes that for lighter weight and lower strength material, such as corrugated cardboard, to be used for the panels of the invention 20 there may be a need to control the speed and/or timing by which a plastic concrete (not shown) is introduced into the form 22. This may further include a need for using time-controlled or sequential/staggered concrete pours for the formation of a concrete structure (not shown) utilizing the form 22. An initial pour of plastic concrete into a form 22 could be calculated and accomplished so that the pressure exerted by the initial plastic concrete pour upon the panels 30 will not overwhelm or otherwise rupture the panels 30 or the assembly of panels 30 into a form 22. The pours into the assembled forms 20 can be calculated (timed or otherwise staggered) to let each preceding layer of plastic concrete to initially set (into concrete) so that it would no longer exert outward pressure on the panels 30. Once an earlier concrete pour has set, then subsequent pours could be introduced (e.g., be placed on top of earlier the set concert pour[s]) in a manner to substantially avoid overwhelming and blowing out the panels 30 or their overall assembly while in the subsequent pours are in their plastic phase.

Figure 5:
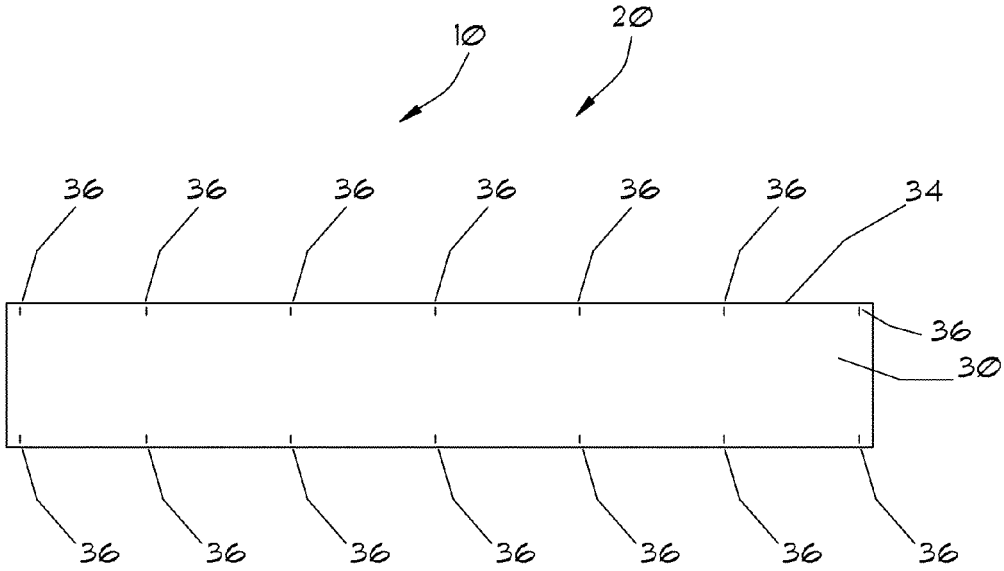
FIG. 5 is substantially a side view of one embodiment of footing panel of the present invention.
Figure 6:
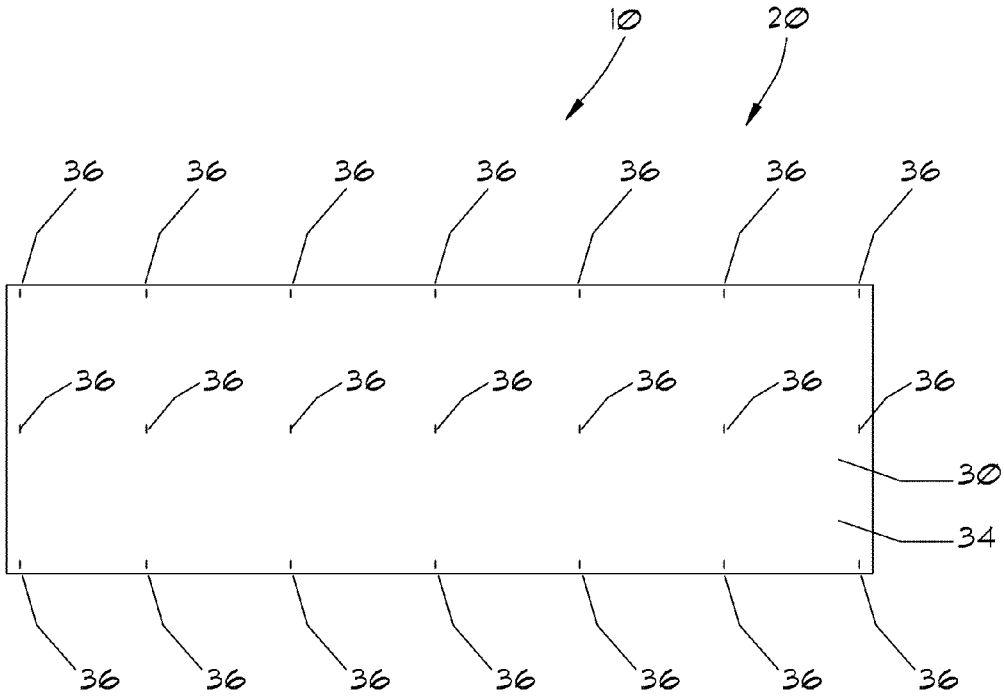
FIG. 6 is substantially a side view of one embodiment of wall panel of the present invention.

As substantially shown in FIGS. 5 and 6, at least one embodiment could have the panels 30 could further comprise of two (2) different-sized panels, e.g., a footing panel 32 which may be used to create footings and a taller wall panel 34, which may be used create walls. The footing panel 32 could have a rectangular shape and have at least two sets of tie apertures 36. An exemplary footing panel 32 could be seen as having dimensions that are generally 8-inches (height) by 48-inches (length.)

Each tie aperture 36 of the set could accommodate the insertion of a respective end 46 of respective footing ties 40 that are holding apart a pair of footing panels in opposing and parallel orientation. Each tie aperture 36 of a set could further be set apart from one another by several inches. Each set of tie apertures 36 could be arranged upon the footing panel 32 in a substantially linear fashion proximate to a respective lengthwise edge of the footing panel 32.

The wall panel 34 could similarly have a rectangular shape and, in at least one embodiment, could also have several sets of tie apertures 36 to accommodate the insertion of ends 46 of wall ties 60 into the panel 30. Each set of tie apertures 36 can be longitudinally oriented in linear fashion upon panel 30 with each tie aperture 36 of a set being set apart from the other (e.g., by several inches.) Two sets could be located proximate to each of the lengthwise edges of the panel 30 while a third set being located along the longitudinal center of the panel 30. An exemplary footing panel 34 could be seen as having dimensions that are generally 16-inches (height) by 48-inches (length.)

Figure 7:
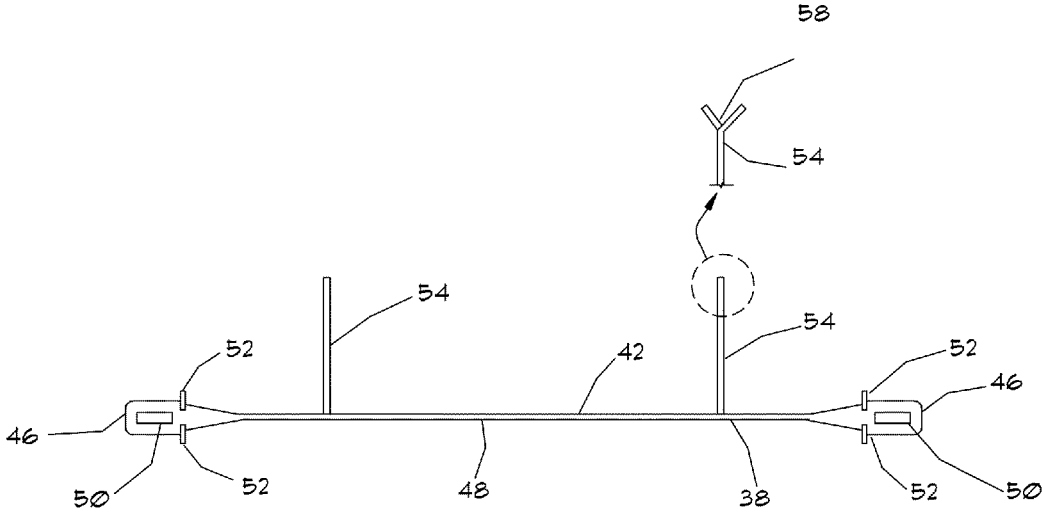
FIG. 7 is substantially an isometric side view of one embodiment of the footing tie of the present invention.
Figure 8:
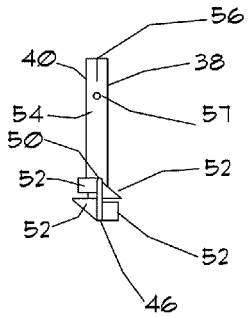
FIG. 8 is substantially an end view of one embodiment of footing tie of the present invention.
Figure 9:
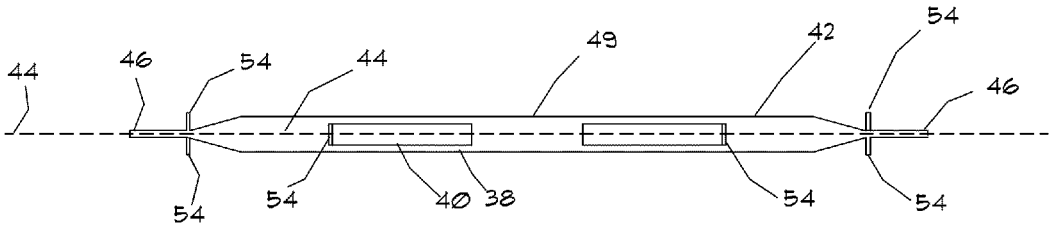
FIG. 9 is substantially a top view of one embodiment of footing tie of the present invention.

The plurality of ties 38 could comprise of footing ties 40 and wall tics 60. As substantially shown in FIGS. 7, 8, and 9, a footing tic 40 could be a rectangular strip 42 (e.g., 13 to 17 inches long-depending on form requirements-to ¾ inch wide) made of metal (e.g., 18 gauge sheet metal) or other suitable material. The strip 42 could have a longitudinal centerline axis 44 and be further segmented into two ends 46 sandwiching a body 48. The ends 46 could be twisted (e.g., rotated around the longitudinal centerline axis 44) to allow the plane of each end 46 to be moved away from (e.g., by ninety degrees) from the plane of the body. Each end 46 could further feature a locking aperture 50 through which a locking mechanism 80 may reversibly engage. In this manner, when secured between an assembled pair of panels (100) (generally shown in FIG. 1), the body of the tooting tie could be presented to top 24/bottom 25 of the form 22. This could allow the bodies 48 of a top set/tier of footing ties 40 to be oriented to generally allow the top layer of plastic concrete as placed in the footing form 22 to be screed fiat. This body orientation could also allow support tabs 54 to secure a wall form 22 to footing created by the invention 10 (a plurality of support tabs 54 could be raised from their respective bodies 48 to be raised to engage various perforations 76 of L-shaped bracket located along bottom edges of assembled pairs of wall panels 100.)

One each end 46 could further have a set of stop tabs 52 substantially located between the locking aperture 50 and the body 48. The set of stop tabs 52 could be oriented perpendicular to and project away from their respective end 46. One stop tab 52 could be projecting from one side of the end 46 while the other stop tab 52 could be projecting away from the other side of the end 46. In one possible embodiment, the stop tab 52 could be formed from the end 46 by cutting one or more sides of the stop tab 52 free from the end 46 and then bending the stop tab 52 about a side that is still connected to the end 46. When making an assembled pair of panels 100 (generally shown in FIGS. 1-4), a tie 40 could be inserted into the tie aperture 36 of the panel 30 allowing the stop tabs 52 could be placed against a (e.g., inner) side of a panel 30 to substantially prevent the remainder of the tie 40 from passing through a tie aperture 36 of the panel 30.

In at least one embodiment, the footing tie 40 could further feature one or more support tabs 54 that project up and away from the same side of the body 48 to be oriented perpendicular to the plane of the body 48. The each of the support tabs 54 (generally a pair of support tabs 54 per footing tie 40) could located proximate where an end 46 connects to the body 48. An unattached tip of each support tab 54 could feature a longitudinal center cut 56 to allow the tip to be splayed open (e.g., by flathead screw driver or like-not shown) to generally form the tip into V-shaped notch 58. A tying aperture 57 could be located proximate to the base or bottom of the cut 56 to allow a suitable tying-means (e.g., wire-not shown) pass through the support tab 54 to be warped around a cut horizontal rebar (not shown) to generally secure it in place on splayed V-shaped notches 58. This action could be repeated on several various footing ties 40 (generally those of the same tier) to lock the horizontal rebar in place within the footing form 22. In one possible embodiment, the support tab 54 could be made from the body 48 itself, wherein three of its four sides may be cut separate from the body 48 leaving a side that is still continuous to the body 48 allowing the support tab 54 to be bent up and away from the body 48 around the continuous side. This could allow the support tab 54 to substantially become perpendicular to the plane of the body 48.

In operation, when the ends 46 are inserted into respective panels, the body of the foot tie can be seen as being in a parallel orientation to the top and bottom of the assembled form 22 while the body 48 (and respective ends 46) of the wall tie 60 are generally presented to be parallel to the front and back of the assembled form 20. In this way, the support tabs 54 of the footing ties 40 may project upwards towards the top of the assembled form 22 to appropriately be able to receive and hold rebar (not shown) as needed to reinforce a footing created by the forms 22. Generally, the deployment (e.g., bending away from the body 48) of the support tabs 54 as rebar support could be limited to lower tier of footing ties 40 used to hold the form 22 (e.g., footing) together. Additionally, in at least in one embodiment, the body 48 could have a curved lateral cross section (not shown) to give the body 48 greater rigidity and strength to support the weight of horizontal rebar (not shown) placed upon it.

Figure 10:
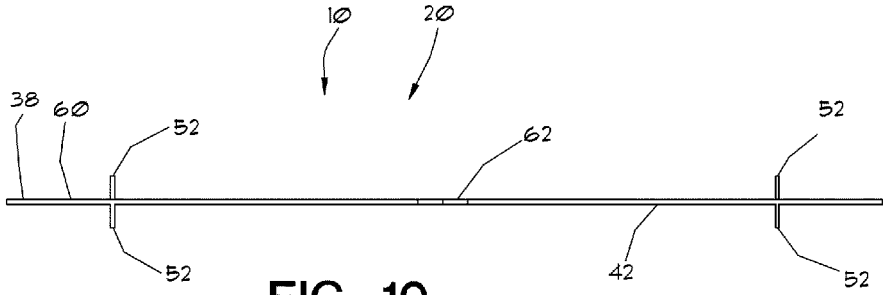
FIG. 10 is substantially a side view of one embodiment of wall tie of the present invention.
Figure 11:
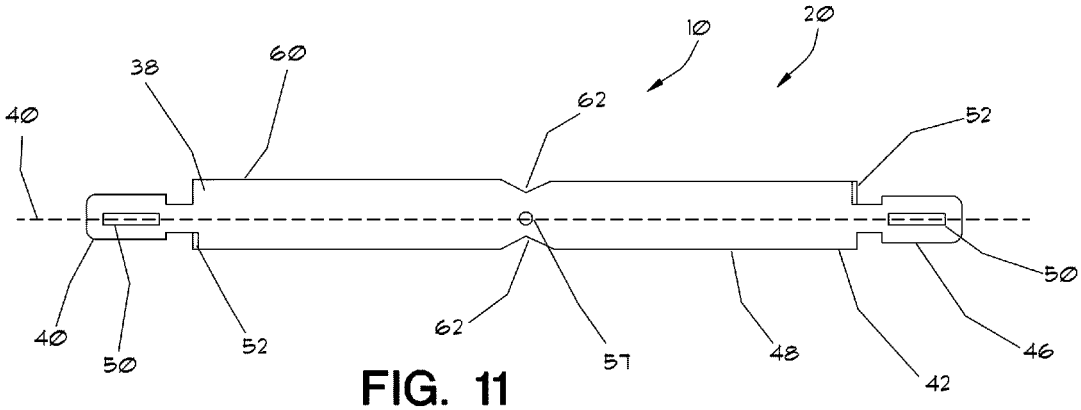
FIG. 11 is substantially a top view of one embodiment of wall tie of the present invention.
Figure 12:
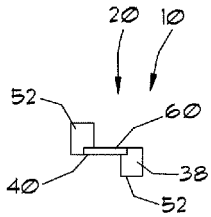
FIG. 12 is substantially an end view of one embodiment of wall tie of the present invention.

As substantially shown in FIGS. 10, 11, and 12, the wall tie 60 could be similar in construction to the footing tie 40 except it would generally lack support tabs 54 for rebar support and its ends 46 would remain in the same plane as the body 48. The lengthwise edges of the body could be slightly indented at the center of the body 48 maybe to substantially form a cradle 62. This cradle may be used to support cut horizontal rebar (not shown) that may be embedded in the formed wall. Center of the body 48 may further feature a tying aperture 57 through which wire or other suitable means may be passed to secure rebar that is cradled by the wall tie 60.

Both wall ties 60 and footing ties 40 could further feature a lateral crease or suitable indentation (not shown) between the tie body 48 and each respective end 46. This crease could be used after the tie has been incorporated into the formed concrete structure to facilitate the breaking off of its exposed ends 46 after the panels 30 and L-shaped brackets 70 have been removed from the formed concrete structure created by the form 22.

Figure 13:
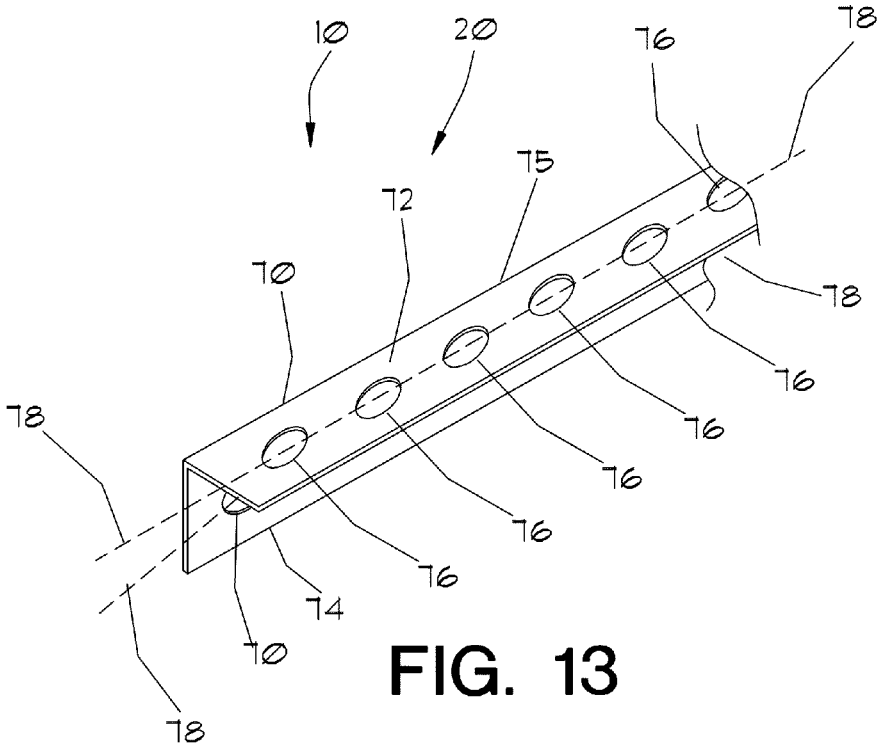
FIG. 13 is substantially a perspective view of one embodiment of tie of the present invention.
Figure 15:
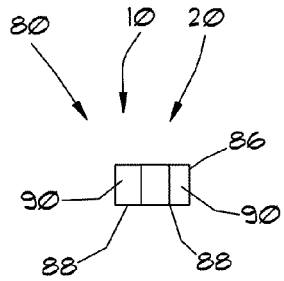
FIG. 15 is substantially a top view of one embodiment of U-shaped pin of the present invention.
Figure 16:
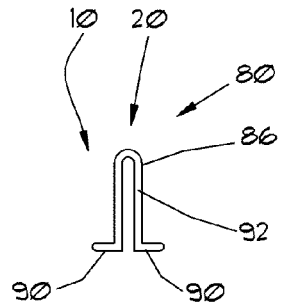
FIG. 16 is substantially a top view of one embodiment of U-shaped pin of the present invention.
Figure 17:
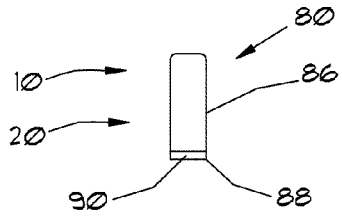
FIG. 17 is substantially a front view of one embodiment of U-shaped pin of the present invention.
Figure 18:
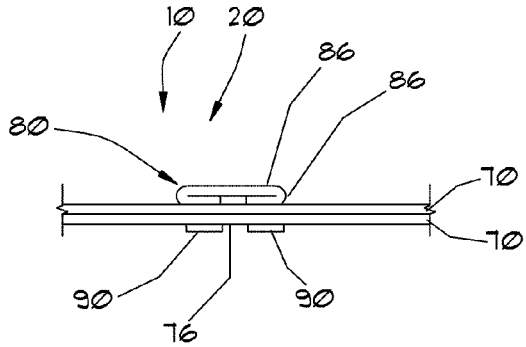
FIG. 18 is substantially a side view of one embodiment of U-shaped pin of the present invention.
Figure 19:
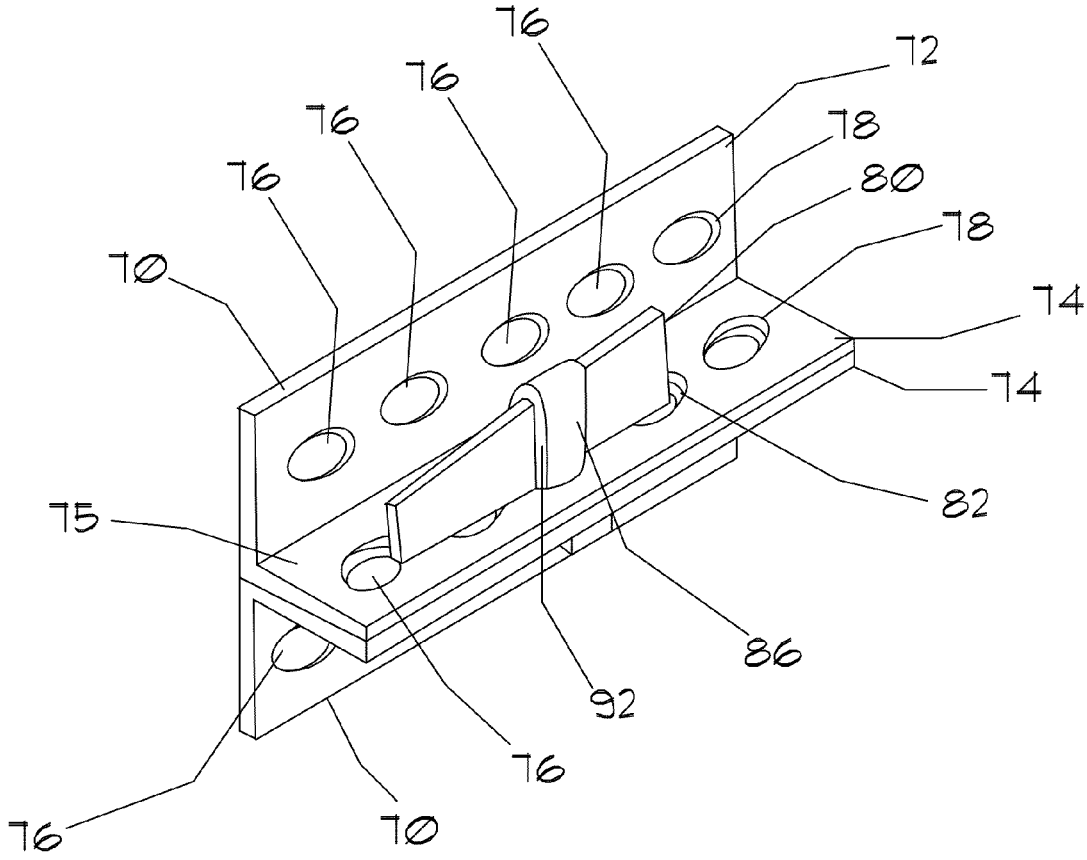
FIG. 19 is substantially a front view of one embodiment of U-shaped pin mushroomed to hold together two L-shaped brackets of the present invention.

As substantially shown in FIG. 13, the L-shaped bracket 70 could comprise of a top flange 72 and bottom flange 74 of definite lengths continuously connected to one another along a common edge 75 in perpendicular orientation. Each flange 72, 74 could further having a respective set of spaced (e.g., 1 inch apart) circular perforations (e.g., ⅜ inch diameter) located along the flanges' lengthwise center 78. The L-shaped bracket 70 could be made from 18 gauge steel sheet, aluminum, or other suitable material. One such L-shaped bracket 70 that is long as its corresponding panel 30 could be a panel L-shaped bracket 71 and is generally located over a set of tie apertures of the panel so that its one or more of its perforations substantially match up with the respective tie apertures 36 for that set.

Another shorter length of such L-shaped bracket 70 could be a connector L-shaped bracket 73 used to connect panels (e.g., of two assembled pairs of panels 100) in tandem fashion. To accomplish this, the connector L-shaped bracket 73 may be located over portions of panel L-shaped brackets 71 from the respective adjacent panels (e.g., top edge panel L-shaped brackets 71.) The perforations 76 of connector L-shaped bracket 73 are generally aligned with a plurality of perforations of the two panel L-shaped brackets 73. This could allow wedge 82 and U-shaped pin 86 combination or end 46 and wedge 82 combinations to secure the connector L-shaped brackets 73 in place upon the adjacent, and now connected, panels 30.

Figure 14:
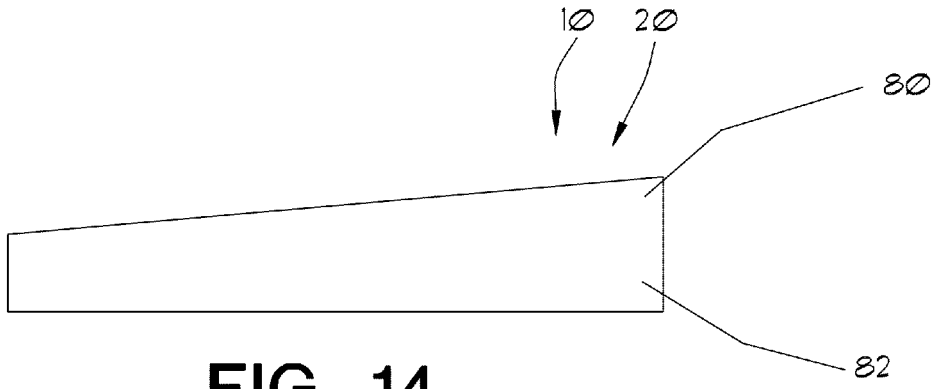
FIG. 14 is substantially a side view of one embodiment of wedge of the present invention.

As substantially shown in FIG. 14, the locking mechanism 80 could comprise of wedge 82, which in one embodiment could include an isosceles trapezoid-shaped plate made from 14-gauge sheet metal (or other suitable material) and have dimensions such as ⅝ inch wide at one end and ¼ inch wide at the opposing end. The wedge 82 could be reversibly lodged into a respective locking aperture 50 of the end 46 of the footing/wall ties 40, 60 as it protrudes through a respective tie apertures 50 of the panel 30 (as substantially shown in FIG. 1). When the wedge 82 is driven into the locking aperture 50 of a tie end 46, the wedge 82 could compress against a flange 72, 74 of an L-shaped bracket 70. In this manner, the wedge 82 moves the tip of the end 46 away from the L-shaped bracket 70 and the panel 30 (or it can be seen as moving the L-shaped bracket 70 and panel 30 along the end 46 against the stop tabs 52) to tightly compress and lock the panel 30 against the stop tabs 52 of ties 38 to substantially allowing for the assembly of the panels 30 into assembled pair of panels 100/the form 22.

As substantially shown in FIGS. 15, 16, 17, 18, and 19, the locking mechanism 80 in another embodiment could further comprise of a U-shaped pin 86 with two pin ends 88, each pin end 88 having a respective pin tab 90. The pin tab 90 protruding outward from and perpendicular to its respective pin end 88 to provide an engaging surface that generally prevents the U-shaped pin 86 totally passing though aligned perforations 76 of L-shaped brackets 70. Upon such an insertion, the U-shaped pin 86 could further form a channel 92 to receive the wedge 82 to generally reversibly hold multiple L-shaped brackets 70 together.

The U-shaped pin 86 could be configured to generally fit within aligned perforations 76 of multiple L-brackets 70 (e.g., such alignment occurring when assembled pairs of panels 100 with affixed L-shaped brackets 71 are suitably stacked upon one another or when assembled pairs of panels are connected in tandem fashion by connector L-shaped brackets 73 that generally overlay panel L-shaped brackets 71 of the assembled pairs). Once so fitted, the pin 86 could further reversibly receive a wedge 82 through the channel 92 to lock the two L-shaped brackets 70 together to provide a means to hold stacked assembled pairs of panels 100 together. The pin 86 could also be used without the wedge 82 where the pin 86, after insertion into a pair of aligned perforations 76, could have its tip (e.g., the non-open end of the pin 86) deformed (e.g., into a mushroom shape) against a respective flange 72, 74 to generally act like a rivet and to permanently hold multiple L-shaped brackets 70 (and their associated, assembled panel forms 22) together in a more permanent fashion.

When the wall form is assembled on top of the completed footing, this action generally requires the bottom layer of assembled pairs of panels 100 creating the form 22 (wall) to rest upon and be secured to the top of the footing through upright, unsplayed support tabs 54 of the top tier of footing ties that now form an integral part of the completed footing (once the remaining parts of the footing form 22 have been removed.) The bottom of the wall form 22 is oriented (or assembled) upon the upright, unsplayed support tabs 54 of the incorporated footing ties 40 of the concrete footing (not shown) so that the tabs 54 may protrude up through respective perforations 76 of the outwardly protruding flanges of the panel L-shaped brackets 71 running along the bottom edges of the wall form 22. The protruding support tabs 54 could then be bent over the protruding flange of bottom edge L-shaped bracket(s) 70 (e.g., outward from the wall form 22) to substantially secure the wall form 22 to the formed footing.

Figure 20:
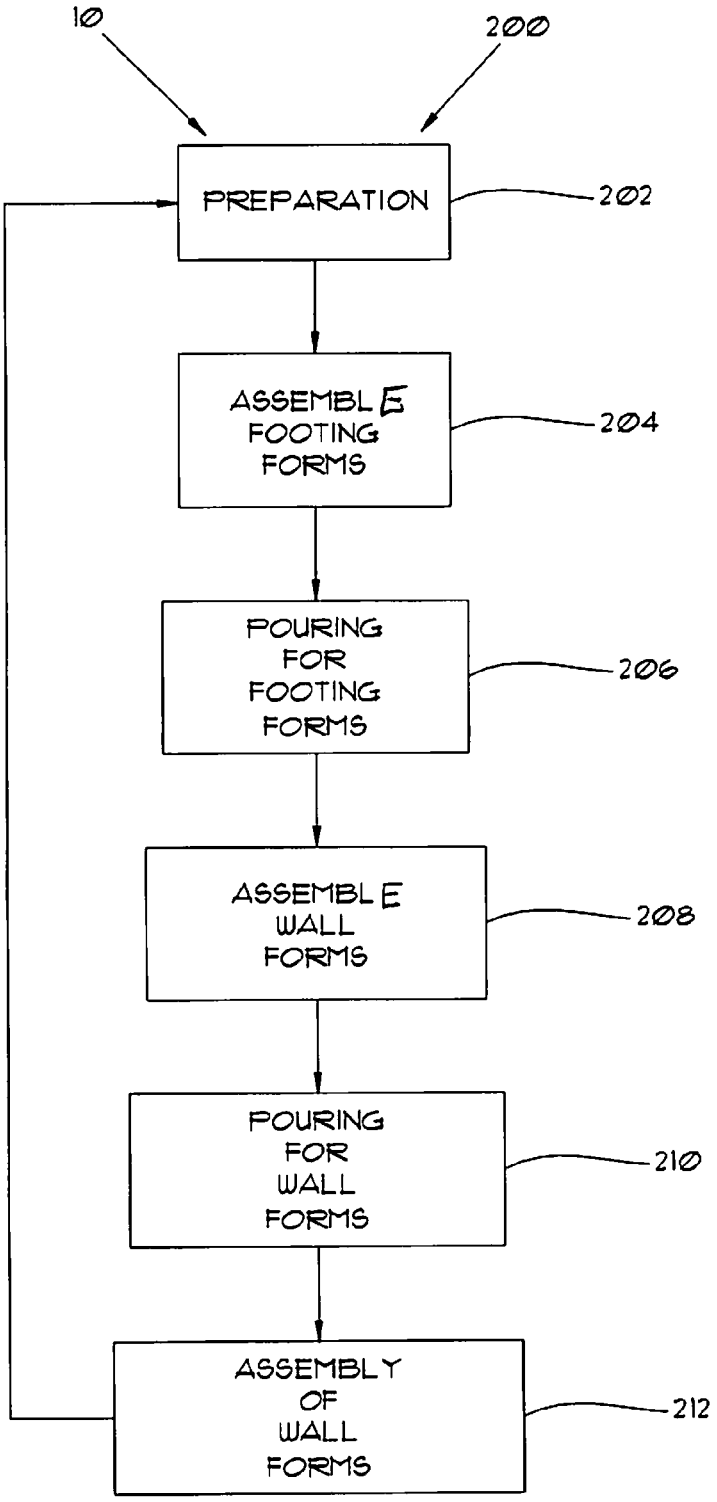
FIG. 20 is substantially a flow chart showing the method of using the system.

As substantially shown in FIG. 20, the method or process 200 of utilizing the system could be commence with step 202, the preparation of both the building site and the system components. For a building foundation preparation (generally for residential & light industrial construction) a shallow excavated trench (generally continuous) for the footprint of the foundation could be established using known construction methods. The foundation could be a continuous concrete footing bearing on undisturbed soil at the bottom of a shallow excavated trench. This footing may be 8 inches deep and may vary in width from 12 inches to 16 inches depending on the weight of the structure above and other structure requirements.

The components of the system 20, such as panels (footing and wall sizes), footing ties, wall ties, L-shaped brackets, locking mechanisms, may be assembled and organized at the site along with other supplies (quantities of concrete mix; stakes and other securing measures for locating in place panel sets/forms to the ground, rebar, securing or tying wire and the like) to commence construction of footing and other needed concrete structures for the building project. Other useful tools may include hammer, pliers, metal shears, and a rebar bending/cutting tool could be instrumental in such a setup. At the substantial completion of this step, the process 200 may proceed to step 204, assembly of footing forms.

In step 204, assembly of footing forms, footing ties may be located between a pair of the panels (footing) so ends of footing ties may be inserted through respective tie apertures (e.g., two sets of tie apertures per footing panel) to protrude outside the assembled footing form. At that point, panel L-shaped brackets, sized and oriented appropriately (so at least a respective flange protrudes outward along a corresponding top lengthwise panel edge and a corresponding bottom lengthwise panel edge) may be fitted over the respective longitudinally located sets of ends/tie apertures so that each end protrudes through a respective tie aperture and L-shaped bracket perforation(s).

For connecting adjacent, tandem-located assembled pairs of panels, connector L-shaped brackets may be employed as discussed above to change the length of the form. The connector L-shaped bracket may applied over portions of the (top edge and bottom edge) panel L-shaped brackets (and respective protruding tie ends) of the panels being connected by the connector L-shaped bracket. The connector L-shaped bracket then may be secured by a plurality of locking mechanisms engaging the tie ends protruding from various aligned perforations of the connector L-shaped brackets and panel L-shaped brackets.

For connecting stacked assembled pairs of panels, panel L-shaped brackets of the assembled pairs, as located along the top and bottom panel edges, may be aligned between assembled pairs to allow the perforations of respective L-shaped brackets (e.g., those flanges which protrude away from the panel) to be aligned and then engaged by locking mechanisms to ultimately adjust the height of the form. The locking mechanisms for this connection may include the wedge and U-shaped pin (e.g., generally reversible connection) or mushrooming the U-shaped pin (generally permanent connection.)

Once the pairs are put together and connected together (e.g., in stacked/tandem fashion) at the site to generally create the form for a foundation or footing, the form as assembled could be otherwise aligned, leveled, and staked securely in place. If rebar is to be incorporated into the formed structure, sections rebar could be cut and bent as required. Vertical rebar can be wired tied to the footing ties as required. For the horizontal rebar, the support tabs of the lower tiers of footing ties could be bent upward and away from the bodies of those ties (generally, only the lower tier of footing ties are used to support rebar.) The notches at the tips of the support tabs could be splayed open to form V-notches upon which the cut sections of horizontal rebar could be placed and be further secured with wire (e.g., passing through the tying aperture and around the rebar.) At the substantial completion of step 204, the process 200 could proceed to step 206, the pouring the concrete for footing.

In step 206, the pouring the concrete for footing, the concrete ingredients could be mixed into plastic concrete and made ready to be placed within the footing form. The concrete pour can be introduced into the form (e.g., a timed pour or staggered pours) so that that initial amount of plastic concrete so poured will not exert panel pressure that will be enough to rupture panels of the form or cause their disassembly. When the initial amount of concrete has substantially set into concrete and has reduced the amount of pressure it is exerting on the panels of the form, subsequent plastic concrete can be introduced into the form, taking care not to overload the capability of the panels/assembled panels to withhold the plastic concrete present in the form.

Once the form has been fully filled, the top layer of plastic concrete may be screed flush with the top L-shaped brackets (the bodies of foot ties being oriented to the form's top and bottom. After the footing concrete has substantially set, any staking equipment present may be removed. Locking mechanisms, the L-shaped brackets (both connector and panel) and footing panels may be removed for later reuse. The ends of the footing ties may be broken off flush with the sides of the footing and discarded. At the substantial completion of step 206, the process may proceed onto step 208, assembly of wall forms.

In step 208, the assembly of the wall forms, the wall ties, L-shaped brackets, locking mechanism, wall panels can be used to make assembled pairs of panels, generally as described-above for the footing sections. As needed, the wall sections could further assembled (and locked) into tandem/stacked fashion to create the wall form of desired height and length.

To attached the narrow wall form to the wider completed foundation or footing, the assembled wall section (or the wall section as being assembled) is substantially located only upon the bodies of the footing ties (e.g., the top tier of the footing ties in the footing form). In this manner, the protruding flanges on the two bottom edge L-shaped brackets of the wall form can be so aligned with the top tier of footing ties so that the securing tabs (e.g., that have been bent upwards away from the bodies of the footing ties of the top tier of ties of the completed footing) may generally protrude through respective perforations of the protruding flanges. Once a securing tab has been inserted through a perforation, the respective securing tab can be bent over the flange (e.g., in outward fashion) to substantially secure the flange to the footing ties of the footing.

Once the wall form is generally assembled and secured to footing form, vertical and horizontal rebar for the wall form could be cut. Vertical rebar could be secured by wire to wall tie bodies as needed. Horizontal rebar could be located on cradles (e.g., edge indentations at the middle the body of the wall ties) of the assembled forms as needed. Wire passing through the securing aperture in the body could be further wrapped around the horizontal rebar to secure it to the body and locate it properly within the connected wall sections/form. Once the wall forms and plumbed and braced appropriately, the process could proceed to step 210, pouring the wall concrete.

In step 210, prepping additional concrete for the wall form. Depending on the height of the wall form and other factors, the concrete could be introduced in staggered pours or poured in a certain timed rate to allow the initial amount of plastic concrete poured in to the wall form to set into concrete before additional plastic concrete is introduced into the wall form to avoid the pressure of the plastic concrete from blowing out or bursting the panels or the assembly of panels for the wall form. After the entire pour for the wall form has substantially set, the process 200 could proceed onto step 212, disassembly of wall forms.

In step 212, disassembly of wall forms, the bracing, if any, is removed along with locking mechanisms, short and panel L-shaped brackets, and panels of the wall form for possible later reuse (if undamaged). The ends of the wall ties are broken off flush (along indented/scored line on the end-body) with the face of the formed wall and discarded. The process 200 could proceed back to step 202 for the construction of additional concrete structures.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As can be seen by the above description and drawings that the invention generally provides a method and panel system for lightweight, inexpensive, easy-to-use (without skilled labor), convenient-to-transport forms as used in making concrete structures. It further allows for recycling of many of the elements of the system after completion of a project. The system further provides the paired panels held apart by ties creating the form to be further stacked or connected in tandem to adjust the height and length of the forms and correspondingly structures being created using the invention. The ties for a footing section may be suitably constructed to support and secure a narrow width wall section of paneling upon wider completed footing.

What is claimed is:

1. A system for creating a form used to make concrete structures comprising:

(A) a plurality of panels, each panel having multiple sets of spaced-apart tie apertures, each set of tie apertures being set in a longitudinal orientation upon the panel, each set of tie apertures being spaced apart from one another in a parallel configuration;

(B) a plurality of ties, each tie comprising of a body, ends, stop tabs, the body being located between two ends with each end having a locking aperture, the stop tabs being located between the respective end and the body;

(C) a plurality of L-shaped brackets, the plurality of L-shaped brackets having top and bottom flanges connected along a common edge in perpendicular orientation to one another, each flange further having a respective set of spaced-apart perforations located along the lengthwise center of the flange;

(D) a plurality of locking mechanisms that can attach to the L-shaped brackets by the perforations and can attach to the ties by the locking apertures;

wherein two or more ties are located between and perpendicular to at least a pair of panels to hold the panels in spaced-apart, parallel and opposing orientation, the ends of the ties protruding through respective tie apertures and corresponding perforations of plurality of L-shaped brackets located on the outside of the panels, said panels and L-shaped brackets being held in place on the ties by locking mechanisms respectively engaging ends to form an assembled pair of panels, two or more assembled pairs of panels are connected together in tandem by overlaying a first L-shaped bracket upon a portion of one of the L-shaped brackets holding one assembled pair of panels together and upon a portion of one of the L-shaped brackets holding another assembled pair of panels together, the two or more assembled pairs of panels then forming a continuous cavity into which plastic concrete is poured to make a concrete structure.

2. The system of claim 1 wherein the panels are made from corrugated cardboard with sealed edges and further coated with water-proof sealer.

3. The system of claim 1 wherein the assembled pairs of panels are respectively stacked upon one another so that the locking mechanism may respectively engage aligned perforations of multiple L-shaped brackets to reversibly hold the assembled pairs of panels together.

4. The system of claim 1 wherein the tie could be a footing tie, with each of the footing tie's ends being twisted around a longitudinal center axis to rest ninety degrees out from the plane of the body.

5. The system of claim 4 wherein the footing tie further comprises of one or more support tabs being located on same side of the body and projecting away from the body in parallel orientation to one another.

6. The system of claim 5 wherein the supporting tab has four sides, three of which are cut away from the footing tie to allow support tab to be bent around the remaining side still connected to the footing tie.

7. The system of claim 5 wherein the support tab has a tip with a notch cut into it that can be splayed open to make the notch V-shaped to receive and support rebar that is horizontally located within a footing form.

8. The system of claim 7 wherein the supporting tab further has a tying aperture below the notch to receive wire that is used to secure rebar placed in a splayed open V-shaped notch.

9. The system of claim 5 where the supporting tab further protrudes through a perforation of the flange of L-shape bracket and is bent over the flange to secure a wall form to a footing formed by the invention.

10. The system of claim 1 wherein one of ties is a wall tie whose two ends and body lie in the same plane, the body further having edges are indented at middle of the body to form a cradle used to support rebar located horizontally in a wall form, the body further having a tying aperture located between the indented edges.

11. The system of claim 1 wherein the locking mechanism is a wedge that can be inserted in a locking aperture.

12. The system of claim 11 wherein the locking mechanism further comprises of a U-shaped pin with tabs at its open ends, the pin being inserted into an two or more aligned perforations to receive a wedge to reversibly hold multiple L-shaped brackets together.

13. The system of claim 11 wherein the locking mechanism further comprises of a U-shaped pin with a closed end and an open end having tabs, the closed end being inserted through perforations that are aligned together, the closed end being further deformed against a flange of an L-shaped bracket to permanently hold multiple L-shaped brackets together.

14. A method of using forms for creating concrete structures comprising the following steps:

(A) providing panels, ties, perforated L-shaped brackets, and locking mechanisms, the ties holding pairs of panels in spaced-apart parallel orientation with ends of the ties penetrating through the panels and perforations of the L-shaped brackets located on the outside of the panels, the locking mechanism holding L-shaped bracket and panel in place on the end of the tie to form an assembled pair of panels well as further connecting assembled pairs of panels into a form for creating a concrete structure;

(B) assembling a first form to create a concrete footing using panels, ties, L-shaped brackets and locking mechanisms;

(C) making a concrete footing using the first form to create a concrete footing and incorporating the ties of the form into the concrete footing;

(D) removing locking mechanisms, L-shaped brackets, and panels from the concrete looting;

(E) assembling a second form to make a concrete wall using panels, ties, L-shaped brackets, and locking mechanisms;

(F) attaching the second form to make a concrete wall to ties incorporated in the footing by protruding a support tab of the tie into a perforation of L-shape bracket of the second form; and (G) making a concrete wall upon the concrete footing using the form to make a concrete wall.

15. The method of claim 14 wherein attaching the second form to make a concrete wall to ties further comprises of a step of bending a support tab up and away from a body of the tic to place the tab in an upright position.

16. The method of claim 14 wherein attaching the second form to make a concrete wall to ties further comprises of a step of bending a support tab of the tie passing through a perforation of L-shape bracket of the form over the L-shape bracket's flange.

17. A method of assembling a form for creating a concrete structure comprising the following steps, but not necessarily in the order shown:

(A) providing a plurality of panels, each panel having two or more sets of spaced-apart tie apertures, each set of tie apertures being set in a longitudinal orientation upon the panel, each set of tie apertures being spaced apart from one another in a parallel configuration upon the panel;

(B) providing a plurality of ties, each tie having a rectangular body located between two ends, each end having a locking aperture to receive a locking mechanism;

(C) providing a plurality of panel L-shaped brackets having top and bottom flanges connected along a common edge in perpendicular orientation to one another, each flange further having a respective set of spaced-apart perforations located along the center length of the flange;

(D) providing a plurality of locking mechanisms that attach to ties as well as connect L-shaped brackets to one another;

(E) locating two or more ties between and perpendicular to at least a pair of opposing panels to hold the panels in spaced-apart, parallel orientation;

(F) longitudinally locating the panel L-shaped bracket on the outside of the panel to aligning the perforations of one flange of the bracket with the set of tie apertures;

(G) inserting the end of the tie through a respective tie aperture and corresponding perforation of panel L-shaped bracket;

(H) engaging at least one of the plurality of locking mechanisms with respective locking aperture of the end of the tie to complete an assembled pair of panels, and (I) connecting two or more assembled pairs of panels in a continous and tandem manner by overlaying a first L-shaped bracket over a first portion of one L-shaped bracket from one assembled pair of panels and over a second portion of another L-shaped bracket from the other assembled pair of panels.

18. The method of claim 17 further comprises the step of aligning two or more perforations of respective L-shaped brackets from stacked assembled pairs of panels to allow a locking mechanism to engage the aligned perforations.

19. The method of claim 17 that further comprises the step of stacking assembled pairs of panels by protruding a supporting tab as formed by a tie through the L-shaped bracket's perforation.

20. The method of claim 17 that further comprises the step of splaying notches in support tabs as formed by the ties to allow the splayed notches to support rebar.

* * * * *